United States Patent [19]

Beer et al.

[11] Patent Number: 4,955,479

[45] Date of Patent: Sep. 11, 1990

[54] PACKAGE WITH PEELABLE PORTION FOR LIGHT SENSITIVE MATERIALS

[75] Inventors: Jeffrey S. Beer, Perkiomenville; Michael D. Gracie, Sr., Kennett Square, both of Pa.

[73] Assignee: Fres-co System USA, Inc., Telford, Pa.

[21] Appl. No.: 398,207

[22] Filed: Aug. 24, 1989

[51] Int. Cl.[5] ..... B65D 65/40

[52] U.S. Cl. ..... 206/455; 206/484.2

[58] Field of Search ..... 206/455, 454, 484, 456, 206/484.2

[56] References Cited

U.S. PATENT DOCUMENTS

| | | | |
|---|---|---|---|
| 1,536,341 | 5/1925 | Hodgson | 206/455 |
| 2,144,453 | 1/1939 | Flynn | 206/455 |
| 2,310,371 | 2/1943 | Lines et al. | 206/455 |
| 3,443,093 | 5/1969 | Lindenmuth et al. | 206/455 |
| 3,779,449 | 12/1973 | Membrino | 206/820 |
| 3,958,693 | 5/1976 | Greene | 206/455 |
| 4,158,409 | 6/1979 | Duinker | 206/455 |
| 4,306,656 | 12/1981 | Dahlem | 206/439 |
| 4,363,841 | 12/1982 | Snow | 383/108 |
| 4,438,164 | 3/1984 | Pfeifer et al. | 206/454 |
| 4,543,280 | 9/1985 | Fujita et al. | 206/524.3 |
| 4,550,048 | 10/1985 | Nakagawa | 206/491 |
| 4,784,906 | 11/1988 | Akao | 206/497 |
| 4,787,506 | 11/1988 | Akao | 206/395 |

*Primary Examiner*—David T. Fidei

*Assistant Examiner*—Jacob K. Ackun, Jr.

*Attorney, Agent, or Firm*—Caesar, Rivise, Bernstein, Cohen & Pokotilow, Ltd.

[57] ABSTRACT

A package comprising first, second and third flexible panels of light-blocking material secured together for holding light sensitive sheet materials therein, with one of the panels being arranged to be completely peeled away and separated from the other panels to provide access to the materials within the package. The package is arranged for insertion into a rigid container where the sheets can be removed for processing. The package comprises a lower panel, a first upper panel, and a second upper panel. Each of the panels is formed of a web of flexible, light-blocking, material, e.g., a laminate of polyester and polyethylene, one or both of which incorporating a light blocking agent. The lower panel has a leading edge, a trailing edge, and a pair of side edges. The first upper panel has a leading edge, a trailing edge, and a pair of side edges. The second upper panel has a leading edge, a trailing edge, and a pair of side edges. The first upper panel is secured to the lower panel by permanent heat seals extending adjacent their respective leading and side edges. The second upper panel is releasably secured to the lower panel by readily peelable seals extending adjacent their respective trailing and side edges, while also being releasably secured to the first upper panel by a readily peelable seal extending adjacent the leading edge of the second upper panel and the trailing edge of the first upper panel.

30 Claims, 3 Drawing Sheets

PACKAGE WITH PEELABLE PORTION FOR LIGHT SENSITIVE MATERIALS

BACKGROUND OF THE INVENTION

This invention relates generally to packaging and more particularly to flexible packaging.

Flexible containers formed of sheet materials have gained wide acceptance in the trade for holding various products therein. Such packages commonly comprise two panels of flexible sheet material, e.g., polyethylene, polyvinylchloride, polyester, etc., which are heat sealed to each other along their periphery to form a sealed chamber in which the packaged product is located.

It has been proposed by a potential customer of the assignee of this invention to construct a package for receipt of a stack of light sensitive film sheets (e.g., X-ray film), to enable individual sheets to be removed from the package for exposure and processing. Owing to the light sensitive nature of the sheet material it is necessary that the package be formed of a material which is light-tight. Various light-blocking flexible materials are commercially available for formation into a package for holding light sensitive materials to prevent ambient light from damaging the materials. The package construction proposed to the applicants' assignee included a base formed of a light-blocking plastic material defining a recess or cavity in which sheets of the light sensitive materials would be disposed. The cavity with the light sensitive materials was to be covered by a pair of panels of light-blocking plastic material to prevent ambient light from reaching those materials. A first of the cover panels was proposed to be permanently secured to the package's base along the cover panel's peripheral edges. The second cover panel was proposed to be permanently secured to the base along one of its peripheral edges while being releasably secured to the base and the first cover panel via a peelable seal along other of its peripheral edges so it could be peeled full back from the first cover panel and partially back from the base to form an access mouth for the light sensitive sheets within the package.

The foregoing package, while apparently generally suitable for its intended purposes, nevertheless is deemed by applicants herein to leave something to be desired from the standpoints of simplicity of construction and effectiveness or efficiency of use. Accordingly, it is believed that a need presently exists for an inexpensive, completely flexible package, formed of a light blocking material, which is readily sealable to store light sensitive materials therein, yet which includes a cover panel which can be readily peeled completely away from the package to provide access to the light sensitive materials stored within the package.

OBJECTS OF THE INVENTION

Accordingly, it is a general object of this invention to provide flexible packaging which overcomes the disadvantages of the prior art.

It is a further object of this invention to provide a flexible package for the storage of light sensitive materials therein and which can be readily opened, when desired.

It is still a further object of this invention to provide a flexible package which is formed of plural panels secured to each other, with one of said panels being arranged to be peeled away and separated from the others to provide easy access to the interior of said package.

It is yet a further object of this invention to provide an easily openable, flexible package for the storage of light-sensitive materials therein which is simple in construction and low in cost.

SUMMARY OF THE INVENTION

These and other objects of this invention are achieved by providing in a package comprising first, second and third flexible panels of light-blocking material secured together for holding light sensitive sheet materials therein, the improvement of one of the panels being arranged to be completely peeled away and separated from the other panels to provide ready access to the materials within the package. The package is arranged for insertion into a rigid container, e.g., corrugated shipping box, rigid plastic box, etc., where the sheets can be removed for processing and comprises a lower panel, a first upper panel, and a second upper panel. Each of the panels is formed of a web of flexible, light-blocking, material. The lower panel has a leading edge, a trailing edge, and a pair of side edges. The first upper panel has a leading edge, a trailing edge, and a pair of side edges. The second upper panel has a leading edge, a trailing edge, and a pair of side edges. The first upper panel is secured to the lower panel by permanent seals extending adjacent their respective leading and side edges. The second upper panel comprises the improvement and is releasably secured to the lower panel by readily peelable seals extending adjacent their respective trailing and side edges, while also being releasably secured to the first upper panel by a readily peelable seal extending adjacent the leading edge of the second upper panel and the trailing edge of the first upper panel. The seals and the panels of the package form an internal chamber therebetween in which the light sensitive sheet materials are located prior to removal for processing.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
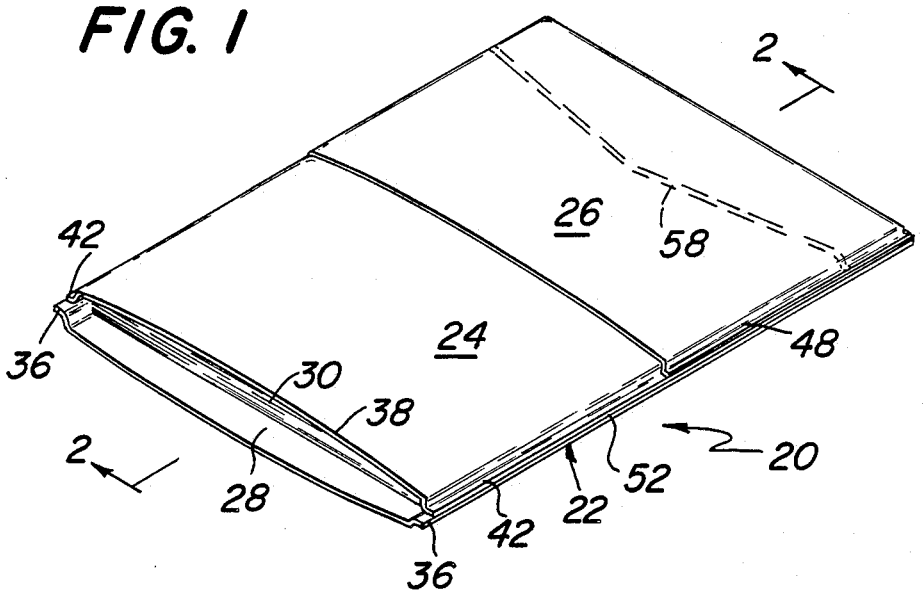
FIG. 1 is an isometric view of a package constructed in accordance with this invention and shown in its condition after it has been filled with light sensitive sheet material, but prior it being sealed.

Referring now to various figures of the drawing where like reference numerals refer to like parts there is shown at 20 in FIG.1 one embodiment of the package of the subject invention. The package basically comprises three panels 22, 24, and 26. The panel 22 comprises a base or bottom panel of the package. The panels 24 and 26 are disposed over and secured to the base panel, and, thus, form the top or upper panels of the package. Each panel is constructed of a flexible film or sheet material which is capable of blocking the passage of light therethrough. The panels are secured together along their respective marginal edges, as will be described hereinafter, to form an interior chamber or cavity 28 in which plural sheets 30 of light sensitive materials, e.g., X-ray film, are to be stored.

Figure 5:
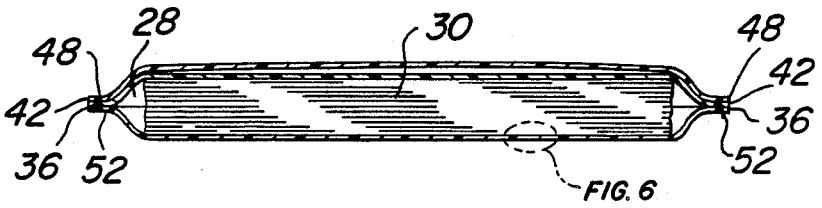
FIG. 5 is a sectional view taken along line 5—5 of FIG. 2.
Figure 6:
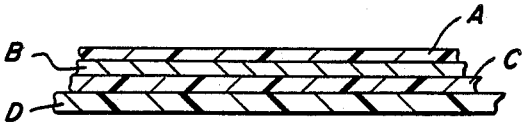
FIG. 6 is an enlarged sectional view of a portion of the package shown in FIG. 5.

As can be seen in FIGS. 1, 2, 5 and 7 the base panel 22 is of generally rectangular shape and includes a front edge 32, a rear edge 34 and a pair of side edges 36. The first upper panel 24 is also of generally rectangular shape and includes a front edge 38 (FIG.1), a rear edge 40 (FIGS. 2 and 7), and a pair of side edges 42 (FIG. 5). The length of the first upper panel 24 is almost as long as the length of the base panel 22. The second upper panel 26 is also of generally rectangular shape, but substantially shorter in length that the first upper panel 24. The second upper panel includes a front edge 44 (FIGS. 1 and 2), a rear edge 46 (FIG. 2), and a pair of side edges 48 (FIG. 5). The length of the upper panel 26 may, if desired, be shorter than shown in the figures herein. Thus, the leading edge 44 of panel 26 will be located closer to the edge 40 of the panel 24.

Figure 4:
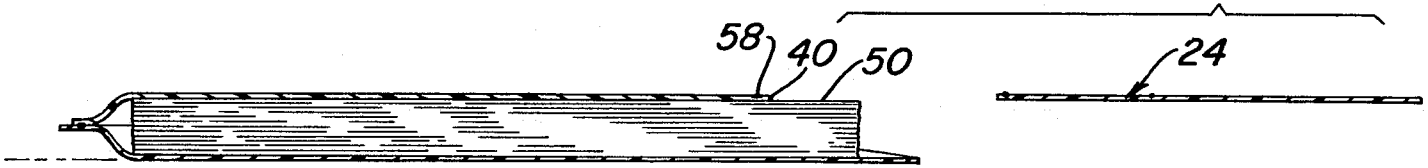
FIG. 4 is an enlarged sectional view like that of FIG. 3 but showing the package after it has been opened and a sheet of the light sensitive material has been removed therefrom.

The first upper panel serves to close off most of the of chamber 28 of the package 20. Thus, the first top panel 24 is disposed over the lower panel so that their respective side edges are aligned, with the lower panel's rear edge 34 extending somewhat beyond the upper panel's rear edge 40 to form a mouth 50 (FIG. 4.) for gaining access to the X-ray film sheets 30 within the interior of the chamber 28. The lower panel's front edge 32 extends just slightly beyond the upper panel's front edge 38 to form a lip for facilitating the filling of the package, i.e., the insertion of the X-ray film sheets 30 into the chamber 28, as will be described later. The first upper panel is permanently secured to the base panel along three of its marginal edges, as will be described later.

The second upper panel 26 serves to close off the package's chamber 28, i.e., seal its mouth 50. Thus, that panel disposed over the first upper panel 26 contiguous with the rear edge 40 of the first upper panel 24 and extends over the package's mouth so that its rear edge is disposed over the rear edge of the lower panel. The second upper panel is releasably secured to the first upper panel and the lower panel so that, when desired, it can be readily peeled away and separated from the package 20 to provide access to the interior of the chamber 28 (as will be described later).

In the preferred embodiment of this invention the panels are each constructed of a laminate of a polyester layer, an aluminum foil layer, a nylon layer, and a polyethylene layer. Moreover, the polyethylene layer includes particles of lamp black therein in the further interests of light blockage. The polyester layer of each panel is identified by the designation "A" and forms the outer layer of the panel. The aluminum layer of each panel is identified by the designation "B" and forms the next outermost layer of the panel. The nylon layer of each panel is identified by the designation "C" and forms the next outermost layer of the panel. The polyethylene layer of each panel is identified by the designation "D" and forms the inner layer of the panel. The use of polyethylene as the inner layer of each panel facilitates the securement of the panels to together, such as by heat sealing, as will be described later. It must be pointed out at this juncture that the construction of the panels 22, 24, and 26 is merely exemplary. Thus, those panels can be formed of other flexible materials, either single ply or multiply, as desired, so long as the resulting panel is flexible, light-blocking, and can be readily sealed to the other panels of the package.

As mentioned earlier the first upper panel 24 is permanently secured to the lower panel 22. This is accomplished by heat sealing their respective abutting side edges 36 and 42 together to form permanent seal lines 52 extending the length of the abutting panels. The front edges of the panels 22 and 24 are also heat sealed together along the entire width of the package. However, that seal 54 (FIGS. 2 and 7) is not made until after the package has been assembled and filled with the X-ray film.

The second upper panel is releasably heat sealed to the first upper panel and to portions of the lower panel via plural peelable seal lines. Those seal lines are formed by heat sealing the abutting portions of the panels together. In order to ensure that those seal lines can be readily pulled apart without damage to the panels the second upper panel 26 includes a peelable coating (not shown) located at the location of all of the peelable seal lines. In accordance with a preferred embodiment of this invention the coating is applied over the entire inner surface 26A of the upper panel, and comprises ethylene vinyl acetate having magnesium silicate therein, such as that sold by Morton Chemical Company under the designation ADCOTE 33P11.

Figure 2:
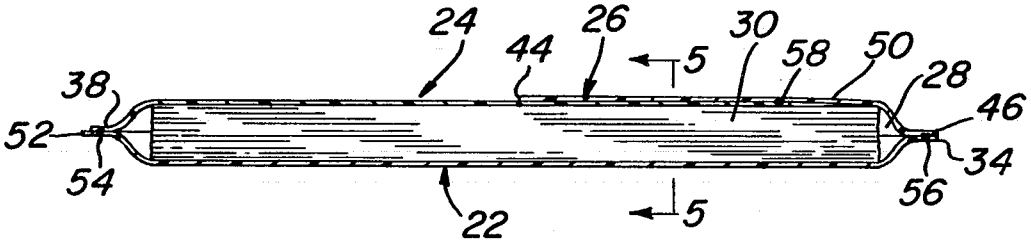
FIG. 2 is an enlarged sectional view taken along line 2—2 of FIG. 1, but showing the package after it has been sealed.
Figure 3:
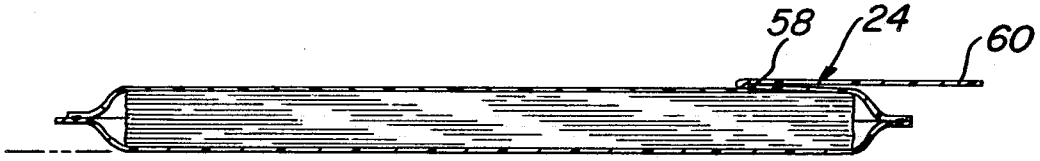
FIG. 3 is an enlarged sectional view like that of FIG. 2 but showing the package in the process of being opened.
Figure 7:
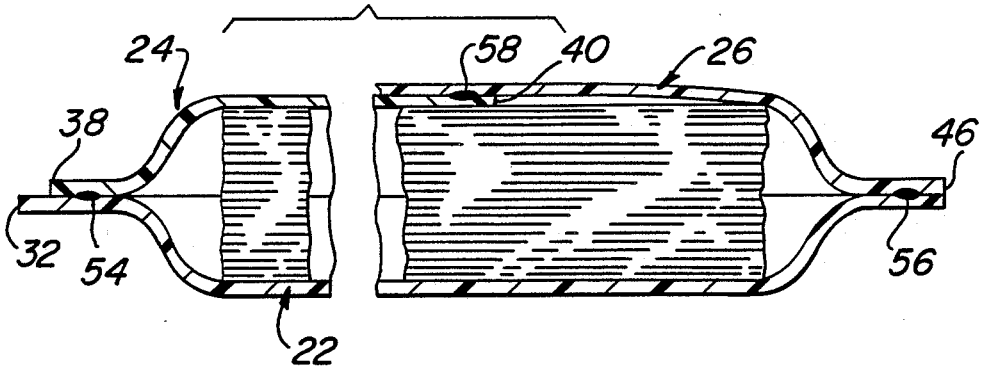
FIG. 7 is a greatly enlarged sectional view, partially broken away, of the package in the condition shown in FIG. 2.
Figure 8:
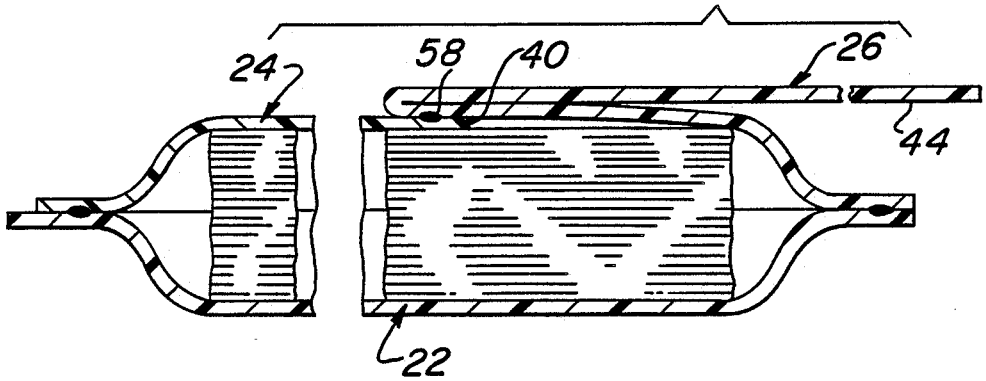
FIG. 8 is a greatly enlarged sectional view, partially broken away, of the package in the condition shown in FIG. 3.
Figure 9:
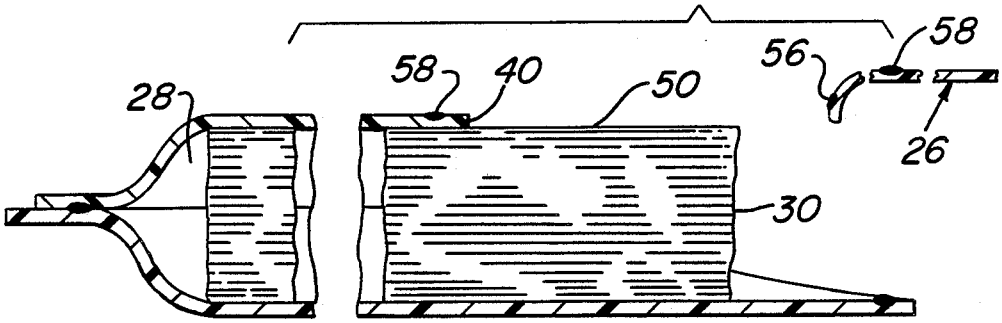
FIG. 9 is a greatly enlarged sectional view, partially broken away, of the package in the condition shown in FIG. 4.

As can be seen the side edges 48 of the second upper panel 26 are heat sealed to the side edges 42 of the first upper panel 24 and to the side edge portions of the lower panel 22 which extend beyond the rear edge 40 of the first upper panel 24 along continuations of the heat seal lines 52. The rear edge 46 of the second upper panel is also releasably heat sealed to the rear edge 34 of the base panel across the entire width of the package by a seal line 56 (FIGS. 2 and 7). So too, the rear edge 40 of the first upper panel is releasably heat sealed to the overlying portion of the second upper panel across the full width of the package by a seal line 58 (FIGS. 2 and 7). The seal line 58 is of a V or chevron shape, with the apex thereof located midway between the side edges of the panel 26 and directed toward the edge 44. The use of a chevron shaped seal, while facilitating the peeling of the panel 26 from the package as will be described later, is not required. Hence a linear transverse seal 58 can be used, if desired.

It must be pointed out at this juncture that other types of sealing techniques can be used to form the permanent as well as peelable seals of the package of this invention. Thus, the use of heat seals is merely exemplary.

In any event once the package is assembled to the state as shown in FIG. 1, that is all of the seal lines formed except for seal line 54, the package 20 is ready to be filled (loaded) with the sheets 30. The lip portion of the lower panel formed by its extending edge 32 provides a grasping means (tab) for enabling a person to readily open the interface between the front edges 32 and 38 to insert the film sheets 28 into the chamber while working in the dark. Once the package is filled with the sheets 30 the abutting edge portions 32 and 38 are heat sealed across the full width of the package by line 54. This sealing action is preferably conducted in a vacuum so that no air is located within the chamber. This vacuum sealing action ensures that the sheets can be stored for long periods of time without degradation or abrasion.

The package can now be brought into the light for storage and subsequent use. As will be appreciated by those skilled in the art, the chevron shape of the seal line 58 provides for the easy peeling of the panel 26 from the panel 24 along that line. Continued peeling of the panel opens the package's mouth 50, thereby enabling the sheets 30 to be removed. The sheets 30 can then be carried to the desired location for exposure to the X-rays and subsequent processing.

As should be appreciated from the foregoing the package of the subject invention is low in cost and can be fabricated quickly and easily. Its light-blocking, hermetic storage properties, coupled with its ability to be easily loaded, sealed shut and then when desired readily opened in a light-tight environment makes it particularly suitable for use as a sheet film cassette for X-ray or other similar apparatus.

Without further elaboration, the forgoing will so fully illustrate our invention that others may, by applying current or future knowledge, readily adopt the same for use under various conditions of service.

We claim:

1. In an open package adapted for receiving light sensitive sheet materials therein and for being sealed to hold and protect said materials from ambient light, said package after being filled with said sheet materials and sealed being arranged for insertion into apparatus where said package may be readily opened to provide direct access to said materials so that said materials can be removed directly therefrom for processing, said package comprising a lower panel, a first upper panel, and a second upper panel, each of said panels being formed of a web of flexible, light-blocking material secured together to form an internal chamber for holding said materials therein, the improvement comprising first mouth means in said package through which said materials are introduced into said chamber and which is sealable to enclose said materials therein to prevent light from reaching said materials, and second mouth means which is sealed but readily openable by peeling to provide access to said materials in said chamber, said second mouth means directly communicating with the interior of said chamber and said sheet materials inserted therein, said lower panel having a leading edge, a trailing edge, and a pair of side edges, said first upper panel having a leading edge, a trailing edge, and a pair of side edges, said second upper panel having a leading edge, a trailing edge, and a pair of side edges, said first upper panel being secured to said lower panel by permanent seals extending adjacent their respective side edges, said leading edge of said lower panel and said leading edge of said first upper panel forming said first mouth means therebetween, with said leading edge of said lower panel and said leading edge of said first upper panel being sealable but not sealed to enable said materials to be readily inserted through said first mouth means directly into said chamber, said second upper panel being completely releasably secured to said lower panel by readily peelable seals extending adjacent their respective trailing and side edges, while also being completely releasably secured to said first upper panel by a readily peelable seal extending adjacent said leading edge of said second upper panel and said trailing edge of said first upper panel to form said second mouth means.

2. The package of claim 1 wherein said panels are each formed of a material suitable for enabling said sheet materials to be vacuum sealed within said package.

3. The package of claim 1 wherein said second upper panel is releasably secured to said first upper panel by readily peelable seals extending adjacent their respective side edges.

4. The package of claim 3 wherein said panels are each formed of a material suitable for enabling said sheet materials to be vacuum sealed within said package.

5. The package of claim 1 wherein said leading edge of said lower panel extends beyond the leading edge of said first upper panel to form a lip for facilitating the insertion of said sheet materials through the interface between said unsealed leading edges.

6. The package of claim 1 wherein said peelable seals are formed by a peelable material located at the interfaces of the respective edges of said panels.

7. The package of claim 6 wherein said peelable material comprises a coating on portions of said second upper panel adjacent its leading, trailing and side edges.

8. The package of claim 7 wherein said coating covers substantially the entire surface of said second upper panel.

9. The package of claim 7 wherein said coating comprises ethylene vinyl acetate (EVA) having magnesium silicate therein.

10. The package of claim 1 wherein said lower panel and said first upper panel are each formed of at least one layer of polyester and at least one layer of polyethylene, with said polyethylene layers of said lower panel and said upper panel being sealed together along their respective leading and side edges.

11. The package of claim 10 wherein said permanent seals are heat seals formed at the interface of the polyethylene layers of said lower and first upper panels adjacent their respective leading and side edges.

12. The package of claim 11 wherein said second upper panel comprises at least one layer of polyester and at least one layer of polyethylene.

13. The package of claim 12 wherein said peelable seals are formed by a peelable material located at the interfaces of the respective edges of said panels.

14. The package of claim 13 wherein said peelable material comprises a coating on portions of said second upper panel adjacent its leading, trailing and side edges.

15. The package of claim 14 wherein said coating covers substantially the entire surface of said second upper panel.

16. The package of claim 15 wherein said coating comprises ethylene vinyl acetate (EVA) having magnesium silicate therein.

17. The package of claim 16 wherein each of said panels additionally comprises a metal foil layer.

18. The package of claim 17 wherein said metal foil comprises aluminum foil.

19. The package of claim 16 wherein the polyethylene layer of each of said panels includes lamp black therein.

20. The package of claim 19 wherein each of said panels additionally comprises a metal foil layer.

21. The package of claim 20 wherein said metal foil comprises aluminum foil.

22. The package of claim 7 wherein said lower panel and said first upper panel are each formed of at least one layer of polyester and at least one layer of polyethylene, with said polyethylene layers of said lower panel and said upper panel being sealed together along their respective leading and side edges.

23. The package of claim 22 wherein said second upper panel comprises at least one layer of polyester and at least one layer of polyethylene.

24. The package of claim 23 wherein said coating is located on said polyethylene layer of said second upper panel.

25. The package of claim 24 wherein said coating covers substantially the entire surface of said second upper panel.

26. The package of claim 25 wherein said coating comprises ethylene vinyl acetate (EVA) having magnesium silicate therein.

27. The package of claim 26 wherein each of said panels additionally comprises a metal foil layer.

28. The package of claim 27 wherein said metal foil comprises aluminum foil.

29. The package of claim 28 wherein the polyethylene layer of each of said panels includes lamp black therein.

30. The package of claim 26 wherein the polyethylene layer of each of said panels includes lamp black therein.

* * * * *